US010400463B2

(12) United States Patent
Campbell, Sr.

(10) Patent No.: US 10,400,463 B2
(45) **Date of Patent: *Sep. 3, 2019**

(54) PROTECTIVE BARRIER COMPRISING A SEAM HAVING AN INTEGRATED DUSTCOVER SYSTEM AND A METHOD FOR ITS USE

(71) Applicant: David Landis Campbell, Sr., Harleysville, PA (US)

(72) Inventor: David Landis Campbell, Sr., Harleysville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/179,614

(22) Filed: Jun. 10, 2016

(65) Prior Publication Data

US 2017/0356200 A1 Dec. 14, 2017

(51) Int. Cl.

| | |
|---|---|
| ***E04G 21/30*** | (2006.01) |
| ***E04G 21/24*** | (2006.01) |
| ***E04G 21/32*** | (2006.01) |
| ***D05B 93/00*** | (2006.01) |

(52) U.S. Cl.

CPC ..... *E04G 21/30* (2013.01); *D05B 93/00* (2013.01); *E04G 21/243* (2013.01); *E04G 21/32* (2013.01)

(58) Field of Classification Search

CPC ..... E04G 21/30
USPC ..... 428/57
See application file for complete search history.

(56) References Cited

U.S. PATENT DOCUMENTS

| | | | | |
|---|---|---|---|---|
| 4,416,713 | A * | 11/1983 | Brooks | B29C 65/342 156/273.9 |
| 4,573,420 | A * | 3/1986 | Carson | D05B 35/02 112/142 |
| 8,573,125 | B1 * | 11/2013 | Rossow | F42D 5/05 102/303 |
| 2015/0247707 | A1 * | 9/2015 | Rossow | F42D 5/05 89/36.02 |
| 2017/0356201 | A1 * | 12/2017 | Campbell | E04G 21/30 |

* cited by examiner

*Primary Examiner* — Brent T O'Hern
(74) *Attorney, Agent, or Firm* — Muskin & Farmer, LLC

(57) ABSTRACT

The present protective barrier is similar to those commonly installed beneath ceilings during construction work being performed on ceilings or roofs of buildings, wherein two or more sections are sewn together to construct the protective barrier. However, the present protective barrier also comprises a dustcover, which covers the seam entirely preventing dust from passing through holes created when the seam is sewn using a thread or similar means.

10 Claims, 4 Drawing Sheets

FIG. 1
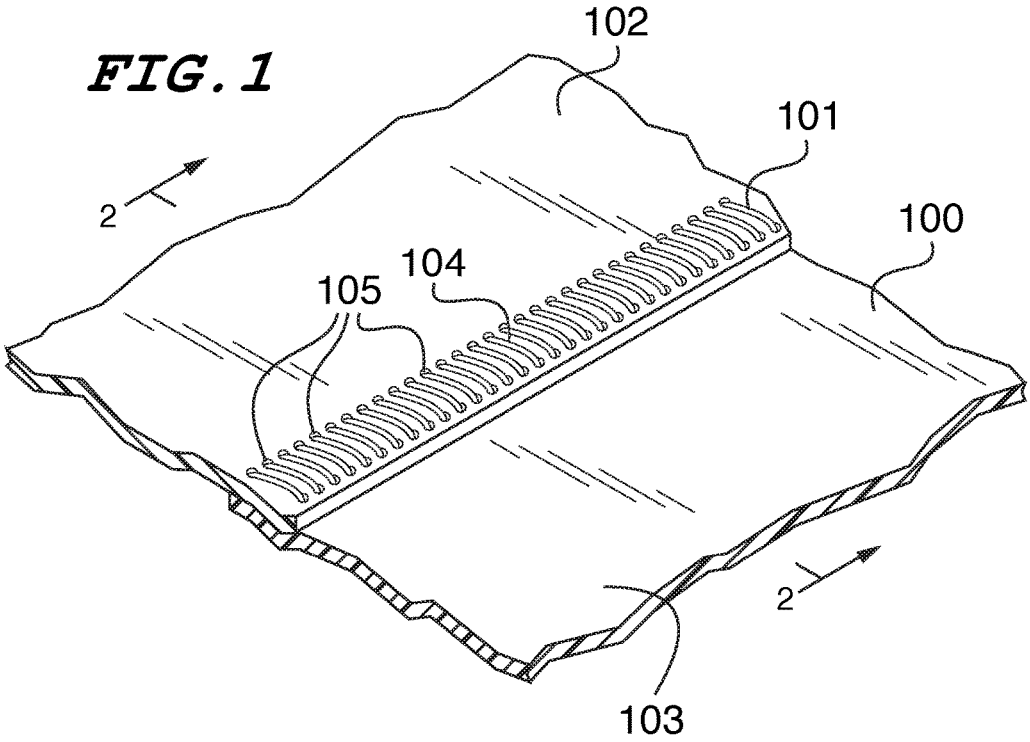
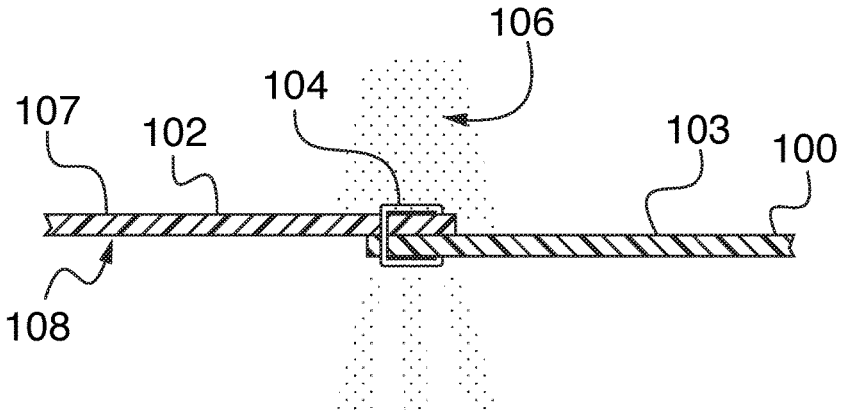
FIG. 2

FIG. 3
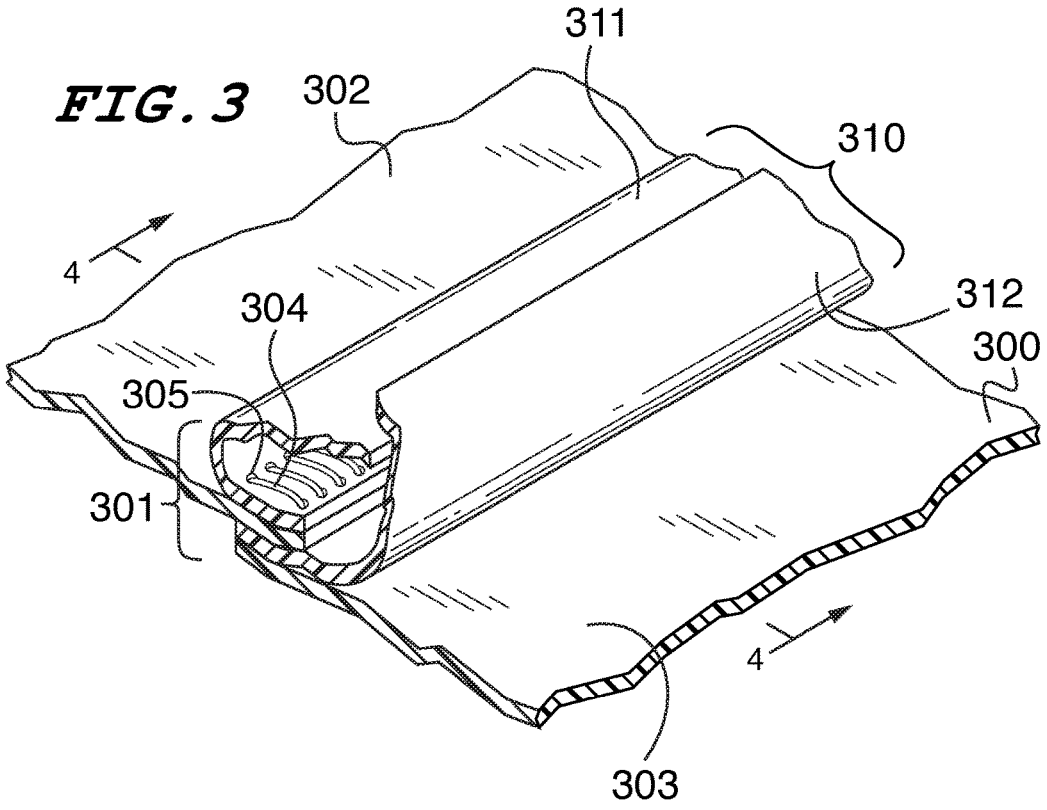
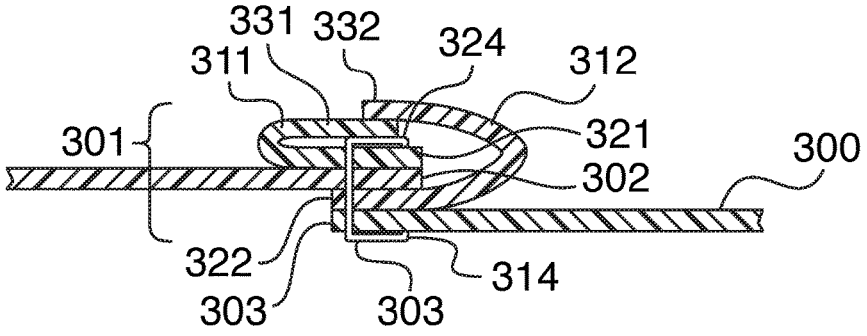
FIG. 4

PROTECTIVE BARRIER COMPRISING A SEAM HAVING AN INTEGRATED DUSTCOVER SYSTEM AND A METHOD FOR ITS USE

FIELD OF THE INVENTION

The present device relates to an improvement to protective barriers that are commonly installed beneath ceilings and in place of walls in buildings that are under construction or being renovated to protect selected areas from dust and moisture created by or permitted to enter due to the work being performed.

BACKGROUND

Protective barriers, such as those described herein, are commonly used to prevent dust, debris and moisture from falling onto floors, people, merchandise and equipment located below ceilings or roofs being repaired or constructed. In this way, the protective barrier protects from added costs from damage or injury resulting from such falling material and encroaching moisture and can allow work to continue below the ceiling or roof under construction. Such barriers are commonly constructed from interconnected sections of polyethylene sheets or similar materials, which have proven to be durable, easy to work with, and relatively inexpensive.

However, a problem can arise with this type or protective barrier, which can allow some dust to pass through the barrier. Specifically, a protective barrier can comprise sections of polyethylene sheets or similar materials connected by seams which are typically made by sewing two or more sections together. The sewing of these seams results in thousands of holes created when a needle, used to sew the sections together, pierces the sections to allow the string to be threaded through them to bind them together. These holes create passageways through which dust and other powdery substances can travel, thus circumventing the purpose of the protective barrier.

What is needed is a protective barrier comprising sections connected by seams sewn together in a way that prevents dust from being able to pass through the holes created by the sewing.

SUMMARY OF THE INVENTION

It is an aspect of the present inventive concept to provide a seam for connecting sections of material, which can be configured to prevent dust from being able to pass through the holes created by the sewing together of two or more sections of polyethylene sheets or similar materials.

The above aspects can be obtained by a protective barrier comprising at least one first section and at least one second section connected by a seam where the first section and second section come into contact with each other, the seam also comprising a dustcover system comprising a first dustcover section and a second dustcover section, wherein each is connected to the first section and the second section, wherein the seam is at least partially covered by a part of the first dustcover section and a part of the second dustcover section; and a thread connecting the first dustcover section, the second dustcover section, the first section, and the second section, by passing through the first section, the second section, the first dustcover section and the second dustcover section.

The above aspects can also be obtained by a method for constructing a protective barrier, the method comprising: providing a protective barrier, comprising at least one first section and at least one second section, a dustcover system comprising a first dustcover section and a second dustcover section, and a thread; placing the first section and second section into contact with each other creating a seam; placing the first dustcover section and a second dustcover section over the seam; and using the thread to connect the first dustcover section, the second dustcover section, the first section, and the second section, by passing the thread through the first section, the second section, the first dustcover section and the second dustcover section so that the thread is covered by part of the first dustcover section and part the second dustcover section.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which:

FIG. 1 is a schematic drawing of a prior art seam connecting two sections of polyethylene sheets or similar materials to create a protective barrier;

FIG. 2 is a side, cutaway view of the schematic drawing of the prior art seam shown in FIG. 1 connecting two sections of polyethylene sheets or similar materials comprising the protective barrier through which a dust or similar powder is shown passing through the seam;

FIG. 3 is a schematic drawing of a seam connecting two sections of polyethylene sheets or similar materials comprising a protective barrier, wherein the seam comprises a dustcover system, according to an embodiment;

FIG. 4 is a side, cutaway view of the seam connecting two sections of polyethylene sheets or similar materials comprising a protective barrier, as shown in FIG. 3, wherein the seam comprises a dustcover system, according to an embodiment;

DETAILED DESCRIPTION

Figure 5:
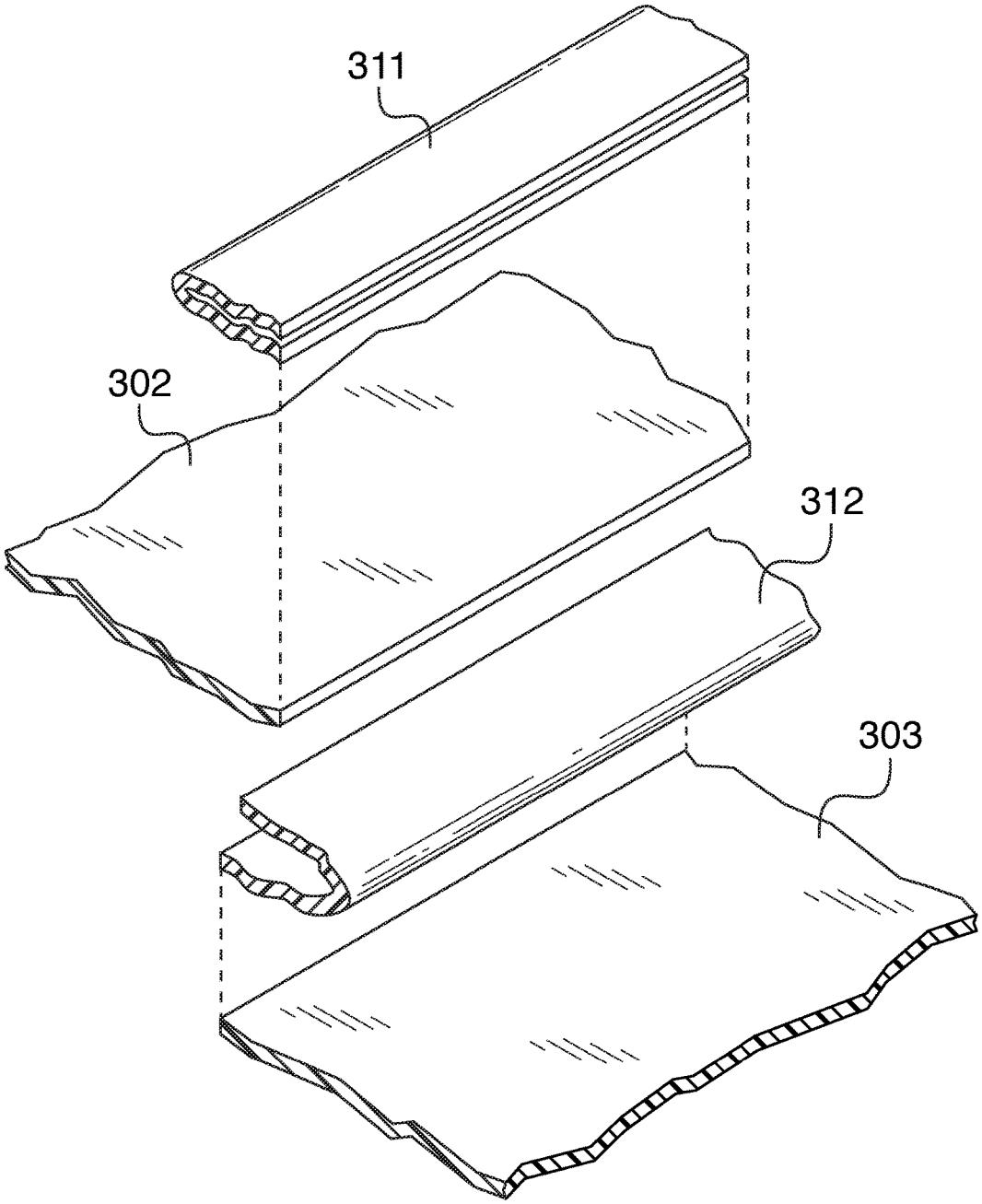
FIG. 5 is an exploded view of the seam connecting two sections of polyethylene sheets or similar materials comprising the protective barrier as shown in FIGS. 3 and 4, wherein the seam comprises a dustcover system, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

The present dustcover system can be used to solve the problem created when two or more sections of polyethylene, or similar materials, are sewn together creating holes through each. Polymers, such as polyethylene, have many attractive features when used as protective barriers including the fact that they are impermeable to almost all types of liquids, powders and small debris including dust and water, and they are relatively inexpensive per square foot. However, a disadvantage of polymers, such as polyethylene, is that, unlike fabrics, holes created when a needle and thread are placed through them do not close or even get smaller over time. Rather, such holes stay the same size as when they were created or get larger and create passageways sufficiently large for dust and water to travel through thus reducing the effectiveness of the protective barrier. The present dustcover system can prevent dust from passing through these holes by covering them with dustcover sections, which are attached to the seam and can interlock over the seam in some embodiments. In some embodiments, these dustcover systems can completely cover the seams further inhibiting the flow of dust and water through the seam.

FIG. 1 is a schematic drawing of a protective barrier 100 comprising a seam 101, which is part of the prior art, connecting a first section 102 of polyethylene sheet or similar material to a second section 103 of polyethylene sheet or similar material using a thread 104, according to an embodiment. In this representational view of the prior art, holes 105 are created each time the thread 104 passes through the first section 102 and second section 103 to create the seam 101.

FIG. 2 is a side, cutaway view of the seam 101, which is part of the prior art, comprising the protective barrier 100 shown in FIG. 1. In this view, the thread 104 comprising the seam 101 is shown connecting the first section 102 to the second section 103 and dust 106 is shown passing from an outer, unprotected side 107 of the protective barrier 100 to an inner, protected side 108 of the protective barrier 100. This passage of dust can be prevented by the present apparatus, in its various embodiments, which are explained in detail below.

FIG. 3 is a schematic drawing of a seam 301 connecting a first section 302 to a second section 303 of a protective barrier 300, wherein the seam 301 comprises a dustcover system 310, according to an embodiment. This dustcover system 310 can be comprised of a first dustcover section 311 and a section dustcover section 312. According to an embodiment, both the first dustcover section 311 and the second dustcover section 312 can be configured to fold over the seam 310, thus preventing dust (not pictured in FIG. 3) from being allowed to pass through the holes 305 created by the thread 304. Specifically, according to an embodiment, the dustcover sections 312 and 313 can be comprised of a polyethylene or similar material which can be made to retain a shape configured to bend over the seam 301 and stay in that position. In addition, the dustcover 310 can be configured so that it can be opened while the seam 301 is sewn and automatically close after the seam 301 has been sewn.

The thread 304, comprising a protective barrier 300, can be made from any standard material used to create thread, including nylon, cotton, silk, polypropylene, polyester and any number of other natural or synthetic materials, which are commonly used to manufacture thread. However, in an embodiment the thread 304 can be comprised of a water soluble material such as polyvinyl alcohol, which can disintegrate when contacted by water allowing the seam 301 to come apart. The benefits of protective barriers comprising such seems have been described in U.S. patent application Ser. No. 13/964,968, which is incorporated by reference herein in its entirety. Similarly, in an alternative embodiment the thread 304 can be comprised of a heat sensitive material such as a copolyamide or polycprolacone, which can disintegrate when subjected to temperatures between 140 degrees and 180 degrees Celsius allowing the seam 301 to come apart at those temperatures. The benefits of protective barriers comprising such seems have been described in U.S. patent application Ser. No. 13/965,137, which is also incorporated by reference herein in its entirety.

FIG. 4 is a side, cutaway view of the protective barrier 300, as shown in FIG. 3, comprising a seam 301 connecting a first section 302 to a second section 303, wherein the seam comprises a dustcover system 310, according to an embodiment. In this figure, the shape of the first dustcover section 311 and the shape of the second dustcover section 312 can each be seen clearly. Specifically, each dustcover section is shown to be a C-shape, wherein each is facing in an opposite direction, according to an embodiment, but this folded-over configuration could also be described as a V-shape or U-shape. As shown, the seam 301 comprises, in order from bottom to top, the thread 304, having a bottom section 314, the second section 303, followed by the first end 322 of the second dustcover section 312, the first section 302, followed by the first end 321 of the first dustcover section 311, and the top section 324 of the thread 304. All of these components are bound together by the thread 304. Above the top section 324 of the thread 304 of a polyethylene or similar material, can be the second end 331 of the first dustcover section 311, which can be made to retain a C-shape configured to bend over the seam 301 and stay in that position. In an embodiment, the first dustcover section 311 can have a C-shape with an opening to the right and the second dustcover section 312 can have a C-shape with an opening to the left. Above the second end 331 of the first dustcover section 311 can be the second end 332 of the second dustcover section 312, which can also bend over the top section 324 of the thread 304 and bend over the second end 331 of the first dustcover section 311. As shown in FIGS. 3 and 4, the thread 304 and the holes 305, shown in FIG. 3, can be covered by the two second ends of the dust cover sections, 331 and 332, comprising the dustcover system 310. The primary advantage of this system 310 is that the second end 331 of the first dustcover section 311 and the second end 332 of the second dustcover section 312 are not punctured by the thread 304, but can still open sufficiently to allow the thread 304 to be installed beneath them. Once the second end 331 of the first dustcover section 311 and the second end 332 of the second dustcover section 312 are in place, as shown in FIGS. 3 and 4, there are no holes available for dust to pass through the protective barrier 300.

FIG. 5 is an exploded view of the seam 301 connecting two sections, 302 and 303, of polyethylene sheets or similar materials comprising a protective barrier 300, previously shown in FIGS. 3 and 4, wherein the seam 301 comprises a first dustcover section 311 and a second dustcover section 312, according to an embodiment. In this embodiment the first dustcover section 311 is adjacent to the first section 302 and the second dustcover section 312 is adjacent to the second section 303.

Figure 6:
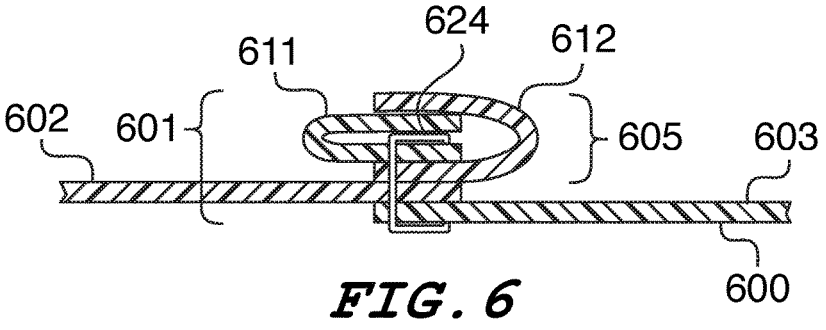
FIG. 6 is a side, cutaway view of the seam connecting a first section and a second section comprising a protective barrier, each comprised of polyethylene sheets or similar materials, wherein the seam comprises a dustcover system, according to an alternative embodiment.

FIG. 6 is a side, cutaway view of the seam 601 connecting a first section 602 and a second section 603 comprising a protective barrier 600. Each can be comprised of polyethylene sheets or similar materials comprising a protective barrier, wherein the seam 601 comprises a first dustcover section 611 and a second dustcover section 612, according to an alternative embodiment. In this embodiment, the dustcover 605 can be comprised of the first dustcover section 611 and second dustcover section 612, which are the same as in the embodiment shown in FIGS. 3 thru 5. However, in this embodiment, the first dustcover section 611 and second dustcover section 612, are located above the point where the first section 602 and the second section 603 come into contact with each other. This alternative configuration can provide the same protection to the seam 601 as that provided by the dustcover system 310 to seam 301 in the embodiment described and shown in FIGS. 3-5.

Figure 7:
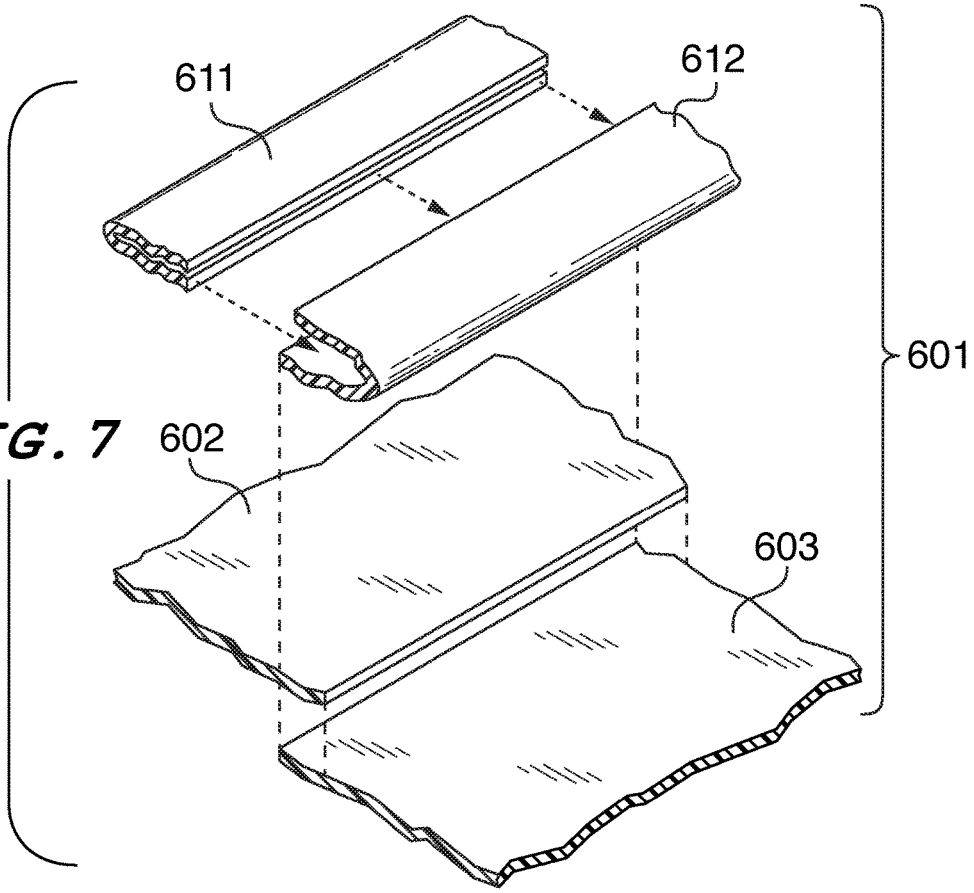
FIG. 7 is an exploded view of the seam shown in FIG. 6 connecting the first section and second section comprising a protective barrier, wherein each is comprised of polyethylene or similar materials comprising a protective barrier, wherein the seam comprises a dustcover system, according to an alternative embodiment.

FIG. 7 is an exploded view of the seam 601 connecting a first section 602 and a second section 603, each comprised of polyethylene sheets or similar materials, comprising a protective barrier 600, wherein the seam 601 comprises a first dustcover section 611 and a second dustcover section 612, according to an alternative embodiment. This view shows how the first section 602 is directly connected to the second section 603 according to this embodiment. Further, this view also shows how the first dustcover section 611 can be located partially within the second dustcover section 612, thus protecting and covering the thread 624 wherein both are located above the first section 602 and the second section 603.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A protective barrier, comprising:

at least one first section and at least one second section connected by a seam where the first section and second section come into contact with each other, the seam also comprising a dustcover system comprising a first dustcover section and a second dustcover section, wherein each is connected to the first section and the second section, wherein the seam is at least partially covered by a part of the first dustcover section and a part of the second dustcover section;

a thread connecting the first dustcover section, the second dustcover section, the first section, and the second section, by passing through the first section, the second section, the first dustcover section and the second dustcover section; and wherein when the first dustcover section is folded into a C-shape with an opening to the right and the second dustcover section is also folded into a C-shape, but with an opening to the left and the first dustcover section is partially located within the opening to the left of the second dustcover section.

2. The protective barrier as recited in claim 1, wherein when the first dustcover section and second dustcover section are each comprised of polyethylene.

3. The protective barrier as recited in claim 1, wherein the thread is comprised of a copolyimide, which are heat-sensitive materials.

4. The protective barrier as recited in claim 1, wherein the thread is comprised of the heat-sensitive material polycaprolactone.

5. The protective barrier as recited in claim 1, wherein the thread is comprised of a polyvinyl alcohol, which is a water-soluble material.

6. A protective barrier, comprising:

at least one first section and at least one second section connected by a seam where the first section and second section come into contact with each other, the seam also comprising a dustcover system comprising a first dustcover section and a second dustcover section, wherein each is connected to the first section and the second section, wherein the seam is at least partially covered by a part of the first dustcover section and a part of the second dustcover section;

a thread connecting the first dustcover section, the second dustcover section, the first section, and the second section, by passing through the first section, the second section, the first dustcover section and the second dustcover section; and wherein when the first dustcover section is folded into a C-shape with an opening to the right and the second dustcover section is also folded into a C-shape, but with an opening to the left and the first dustcover section and the first section are each partially located within the opening to the left of the second dustcover section.

7. The protective barrier as recited in claim 6, wherein the thread is comprised of the polyethylene.

8. The protective barrier as recited in claim 6, wherein the thread is comprised of a copolyimide, which are heat-sensitive materials.

9. The protective barrier as recited in claim 6, wherein the thread is comprised of the heat-sensitive material polycaprolactone.

10. The protective barrier as recited in claim 6, wherein the thread is comprised of a polyvinyl alcohol, which is a water-soluble material.

* * * * *